US010093116B2

(12) United States Patent
Toyama et al.

(10) Patent No.: US 10,093,116 B2
(45) Date of Patent: Oct. 9, 2018

(54) PRINTING APPARATUS AND PRINTING METHOD

(71) Applicant: SEIKO EPSON CORPORATION, Tokyo (JP)

(72) Inventors: Hiroshi Toyama, Shiojiri (JP); Satoru Katagami, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/493,024

(22) Filed: Apr. 20, 2017

(65) Prior Publication Data

US 2017/0305175 A1 Oct. 26, 2017

(30) Foreign Application Priority Data

Apr. 25, 2016 (JP) ..... 2016-087210

(51) Int. Cl.
*B41J 15/16* (2006.01)

(52) U.S. Cl.
CPC ..... *B41J 15/16* (2013.01)

(58) Field of Classification Search
CPC ..... B41J 15/16
See application file for complete search history.

(56) References Cited

U.S. PATENT DOCUMENTS 6,172,688 B1 * 1/2001 Iwasaki ..... B41J 3/4075 347/2
2014/0285563 A1 * 9/2014 Oshima ..... B41J 11/0015 347/16
2015/0151557 A1 6/2015 Oshima

FOREIGN PATENT DOCUMENTS

JP 2010-076400 4/2010
JP 2014-184665 10/2014

* cited by examiner

*Primary Examiner* — Jason Uhlenhake
(74) *Attorney, Agent, or Firm* — Workman Nydegger

(57) ABSTRACT

There is provided a printing apparatus including: a driving roller which drives a recording medium in a predetermined direction by rotation thereof; a supporting member which supports the recording medium further on the downstream side in the predetermined direction than the driving roller; a discharge head which is provided to oppose the supporting member and discharges liquid to the recording medium supported by the supporting member; a tension control portion which adjusts tension of the recording medium supported by the supporting member by controlling tension of the recording medium based on a result of detecting tension of the recording medium further on the downstream side in the predetermined direction than the driving roller; and a first destaticizing portion which destaticizes the recording medium further on the upstream side in the predetermined direction than the driving roller.

11 Claims, 5 Drawing Sheets

PRINTING APPARATUS AND PRINTING METHOD

BACKGROUND

1. Technical Field

The present invention relates to a technology for destaticizing a recording medium which is used in printing.

2. Related Art

A printing apparatus (printer) described in JP-A-2014-184665 includes a recording head disposed to oppose a rotation drum, and prints an image on a recording medium by discharging ink from the recording head while supporting the recording medium (sheet) by the rotation drum. However, in the printing apparatus, there is a concern that various problems caused by electrification of the recording medium occur.

As an example, there is a case where influence on a tension control of the recording medium is generated. In other words, in JP-A-2014-184665, a driving roller is provided further on an upstream side in a transport direction of the recording medium than a supporting member (rotation drum) which supports the recording medium. In addition, by controlling tension of the recording medium based on a result of detecting tension of the recording medium further on the downstream side in the transport direction than the driving roller, tension of the recording medium supported by the supporting member is controlled. According to this, it is possible to appropriately control tension of the recording medium on which liquid discharged from a discharge head lands. However, when the recording medium is electrified, the recording medium sticks to the driving roller when passing through the driving roller. In addition, since the sticking of the recording medium to the driving roller influences the detection result of tension of the recording medium, there is a case where the tension control of the recording medium is not appropriately performed (first problem).

Otherwise, as another example, there is a case where influence on contamination of the discharge head is generated. In other words, when the recording medium is electrified, there is a tendency for mist-like liquid to be likely to adhere to a front surface opposing to the recording medium of the discharge head. In addition, there is also a situation in which the adhesion of the mist-like liquid to the discharge head cannot be easily eliminated by destaticization of the recording medium.

In other words, it is considered that a destaticizing device, such as an ionizer, is used in destaticizing the recording medium. In addition, as such a destaticizing device, a device which performs destaticization using ions generated by applying an AC voltage to a plurality of arranged electrodes is known. However, since there is a tendency for a large number of ions to be imparted being deviated to a part which opposes the electrode in the recording medium, there is a case where uneven destaticization caused by arrangement of the electrodes is generated and the mist-like liquid adheres to a location that corresponds to the uneven destaticization in the discharge head (second problem).

In addition, since an ion balance is not appropriate, there is a case where the recording medium supported by the supporting member cannot be sufficiently destaticized and mist-like liquid adheres to the discharge head which opposes the supporting member (third problem).

SUMMARY

The invention can be realized in the following aspects.

According to a first aspect of the invention, there is provided a printing apparatus including: a driving roller which drives a recording medium in a predetermined direction by rotation thereof; a supporting member which supports the recording medium further on the downstream side in the predetermined direction than the driving roller; a discharge head which is provided to oppose the supporting member and discharges liquid to the recording medium supported by the supporting member; a tension control portion which adjusts tension of the recording medium supported by the supporting member by controlling tension of the recording medium based on a result of detecting tension of the recording medium further on the downstream side in the predetermined direction than the driving roller; and a first destaticizing portion which destaticizes the recording medium further on the upstream side in the predetermined direction than the driving roller.

According to a second aspect of the invention, there is provided a printing method including: driving a recording medium in a predetermined direction by a driving roller by rotating the driving roller; destaticizing the recording medium by a destaticizing portion further on the upstream side in the predetermined direction than the driving roller; adjusting tension of the recording medium supported by the supporting member by controlling tension of the recording medium based on a result of detecting tension of the recording medium further on the downstream side in the predetermined direction than the driving roller; and discharging liquid from a discharge head that opposes the supporting member, to the recording medium supported by the supporting member provided further on the downstream side in the predetermined direction than the driving roller.

In the invention (first and second aspects) configured in this manner, the recording medium is destaticized by the destaticizing portion further on the upstream side in the predetermined direction than the driving roller which drives the recording medium in the predetermined direction. Therefore, since the recording medium is destaticized when passing through the driving roller, sticking of the recording medium to the driving roller is suppressed. As a result, it is possible to accurately detect tension of the recording medium further on the downstream side in the predetermined direction than the driving roller, and to appropriately perform the tension control of the recording medium.

In the printing apparatus, a discharger which performs surface modification treatment with respect to the recording medium by imparting discharge energy to the recording medium further on the upstream side in the predetermined direction than the first destaticizing portion, may be provided. In other words, in the printing apparatus provided with the discharger, since there is a tendency for an electrification amount of the recording medium to increase, influence on the tension control increases as the electrified recording medium sticks to the driving roller. Meanwhile, it is possible to appropriately perform the tension control of the recording medium by destaticizing the recording medium by the destaticizing portion further on the upstream side in the predetermined direction than the driving roller.

In the printing apparatus, a second destaticizing portion which destaticizes the recording medium between the driving roller and the discharge head, may be provided. In this manner, by destaticizing the recording medium in two steps until reaching the discharge head, it is possible to definitely destaticize the recording medium, and to efficiently suppress adhesion of mist-like liquid to the discharge head due to electrification of the recording medium.

In the printing apparatus, the second destaticizing portion may be provided to oppose the supporting member. According to this, it is possible to destaticize the recording medium in the vicinity of the discharge head, and to suppress adhesion of mist-like liquid to the discharge head due to the destaticization of the recording medium.

In the printing apparatus, a front surface of the supporting member may be covered with an insulating layer. In other words, in a case where the front surface of the supporting member has conductivity, there is a concern that the ions generated by the destaticizing portion are oriented toward a part which is not hidden in the recording medium in the supporting member, and the ions cannot be definitely imparted to the recording medium. Meanwhile, by covering the front surface of the supporting member with the insulating layer, it is possible to definitely impart the ions generated by the destaticizing portion to the recording medium, and to reliably destaticize the recording medium.

In the printing apparatus, the first destaticizing portion and the second destaticizing portion may destaticize the recording medium by imparting ions generated by applying an AC voltage to a plurality of arranged electrodes to the recording medium, and an amplitude of an AC voltage generated in the recording medium by the AC voltage applied to the electrode of the second destaticizing portion may be smaller than an amplitude of an AC voltage generated in the recording medium by the AC voltage applied to the electrode of the first destaticizing portion.

In the configuration, the first destaticizing portion disposed on the upstream side and the second destaticizing portion disposed on the downstream side are provided in the predetermined direction in which the recording medium is transported. In addition, an AC voltage having a relatively large amplitude is generated in the recording medium by the AC voltage applied to the electrode of the first destaticizing portion. Therefore, a large difference in applying amount of ions between a part at which the ions are tightly imparted and a part at which the ions are sparsely imparted is generated, and uneven destaticization is likely to be generated in the recording medium destaticized by the first destaticizing portion. Meanwhile, the second destaticizing portion further destaticizes the recording medium after the destaticization by the first destaticizing portion. Moreover, the amplitude of the AC voltage generated in the recording medium by the AC voltage applied to the electrode of the second destaticizing portion is relatively small. Therefore, the second destaticizing portion can similarly destaticize the recording medium compared to the first destaticizing portion, and it is possible to mitigate uneven destaticization of the recording medium after the destaticization by the first destaticizing portion. As a result, it is possible to suppress adhesion of mist-like liquid to the discharge head.

In the printing apparatus, the first destaticizing portion may have a plurality of electrodes provided on one surface side of the recording medium and a plurality of electrodes provided on the other surface side of the recording medium, and a phase of the AC voltage applied to the plurality of electrodes on the one surface side and a phase of the AC voltage applied to the plurality of electrodes on the other surface side may be different from each other by 180 degrees. Otherwise, in the printing apparatus, an interval between the electrode of the first destaticizing portion and the recording medium may be narrower than an interval between the electrode of the second destaticizing portion and the recording medium. In the printing apparatuses, an AC voltage having a relatively large amplitude is generated in the recording medium by the AC voltage applied to the electrode of the first destaticizing portion. Here, it is appropriate to mitigate uneven destaticization of the recording medium after the destaticization by the first destaticizing portion by providing the second destaticizing portion as described above.

In the printing apparatus, a pitch at which the plurality of electrodes are arranged in the first destaticizing portion may be different from a pitch at which the plurality of electrodes are arranged in the second destaticizing portion. In this manner, by making the pitches at which the electrodes are arranged different in the first destaticizing portion and in the second destaticizing portion, it is possible to more efficiently mitigate uneven destaticization of the recording medium after the destaticization by the first destaticizing portion by using the second destaticizing portion.

In the printing apparatus, an adjustment portion which adjusts an ion balance of the first destaticizing portion; and a potential detector which detects a potential of the recording medium supported by the supporting member, may be provided. In the configuration, it is possible to adjust an ion balance of the destaticizing portion while confirming the detection result of the potential of the recording medium supported by the supporting member. Therefore, it is possible to optimize the ion balance. As a result, it is possible to suppress adhesion of mist-like liquid to the discharge head.

In the printing apparatus, a balance control portion which controls an ion balance of the first destaticizing portion by adjusting the ion balance of the first destaticizing portion may be provided in the adjustment portion based on the detection result of the potential detector. In the configuration, it is possible to automatically optimize the ion balance by the balance control portion.

In the printing apparatus, a display portion which displays the detection result of the potential detector; and a balance control portion which adjusts an ion balance of the first destaticizing portion in the adjustment portion in accordance with an input operation, may be provided. In the configuration, it is possible to optimize the ion balance by performing an input operation while confirming the detection result of the potential detector displayed on the display portion by a user.

According to a third aspect of the invention, there is provided a printing apparatus including: a transport portion which transports a recording medium in a predetermined direction; a supporting member which supports the recording medium; a discharge head which is provided to oppose the supporting member and discharges liquid to the recording medium supported by the supporting member; a first destaticizing portion which is provided further on the upstream side in the predetermined direction than the discharge head, and destaticizes the recording medium by imparting ions generated by applying an AC voltage to a plurality of arranged electrodes to the recording medium; and a second destaticizing portion which is provided between the first destaticizing portion and the discharge head, and destaticizes the recording medium by imparting ions generated by applying an AC voltage to a plurality of arranged electrodes to the recording medium, in which an amplitude of an AC voltage generated in the recording medium by the AC voltage applied to the electrode of the second destaticizing portion is smaller than an amplitude of an AC voltage generated in the recording medium by the AC voltage applied to the electrode of the first destaticizing portion.

According to a fourth aspect of the invention, there is provided a printing method including: transporting a recording medium in a predetermined direction; discharging liquid to the recording medium supported by a supporting member from a discharge head provided to oppose the supporting member; destaticizing the recording medium by imparting ions generated by applying an AC voltage to a plurality of arranged electrodes in a first destaticizing portion provided further on the upstream side in the predetermined direction than the discharge head, to the recording medium; and destaticizing the recording medium by imparting ions generated by applying an AC voltage to a plurality of arranged electrodes in a second destaticizing portion provided between the first destaticizing portion and the discharge head, to the recording medium, in which an amplitude of an AC voltage generated in the recording medium by the AC voltage applied to the electrode of the second destaticizing portion is smaller than an amplitude of an AC voltage generated in the recording medium by the AC voltage applied to the electrode of the first destaticizing portion.

In the invention (third and fourth aspects) configured in this manner, the first destaticizing portion disposed on the upstream side and the second destaticizing portion disposed on the downstream side are provided in the predetermined direction in which the recording medium is transported. In addition, an AC voltage having a relatively large amplitude is generated in the recording medium by the AC voltage applied to the electrode of the first destaticizing portion. Therefore, a large difference in applying amount of ions between a part at which the ions are tightly imparted and a part at which the ions are sparsely imparted is generated, and uneven destaticization is likely to be generated in the recording medium destaticized by the first destaticizing portion. Meanwhile, the second destaticizing portion further destaticizes the recording medium after the destaticization by the first destaticizing portion. However, the amplitude of the AC voltage generated in the recording medium by the AC voltage applied to the electrode of the second destaticizing portion is relatively small. Therefore, the second destaticizing portion can similarly destaticize the recording medium compared to the first destaticizing portion, and it is possible to mitigate uneven destaticization of the recording medium after the destaticization by the first destaticizing portion. As a result, it is possible to suppress adhesion of mist-like liquid to the discharge head.

According to a fifth aspect of the invention, there is provided a printing apparatus including: a transport portion which transports a recording medium in a predetermined direction; a supporting member which supports the recording medium; a discharge head which is provided to oppose the supporting member and discharges liquid to the recording medium supported by the supporting member; a destaticizing portion which is provided further on the upstream side in the predetermined direction than the discharge head, and destaticizes the recording medium by imparting ions generated by applying an AC voltage to arranged electrodes to the recording medium; an adjustment portion which adjusts an ion balance of the destaticizing portion; and a potential detector which detects a potential of the recording medium supported by the supporting member.

According to a sixth aspect of the invention, there is provided a printing method including: transporting a recording medium in a predetermined direction; discharging liquid to the recording medium supported by a supporting member from a discharge head provided to opposes the supporting member; destaticizing the recording medium by imparting ions generated by applying an AC voltage to arranged electrodes in a destaticizing portion provided further on the upstream side in the predetermined direction than the discharge head, to the recording medium; detecting a potential of the recording medium supported by the supporting member; and adjusting an ion balance of the destaticizing portion based on the detected potential.

In the invention (fifth and sixth aspects) configured in this manner, it is possible to adjust the ion balance of the destaticizing portion while confirming the detection result of the potential of the recording medium supported by the supporting member. Therefore, it is possible to optimize the ion balance. As a result, it is possible to suppress adhesion of mist-like liquid to the discharge head.

In addition, in order to solve a part or the entirety of the above-described problem, or in order to achieve a part or the entirety of the effects described in the specification, all of the above-described plurality of configuration elements in each aspect of the invention are not necessary, and a part of the plurality of configuration elements can be appropriately changed, removed, or switched to other new configuration elements, and partial removal of limited contents is possible. In addition, in order to solve a part or the entirety of the above-described problem, or in order to achieve a part or the entirety of the effects described in the specification, a part or the entirety of technical characteristics included in one aspect of the above-described invention can be combined with a part or the entirety of the technical characteristics included in other above-described aspects of the invention, and can also be one independent aspect of the invention.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
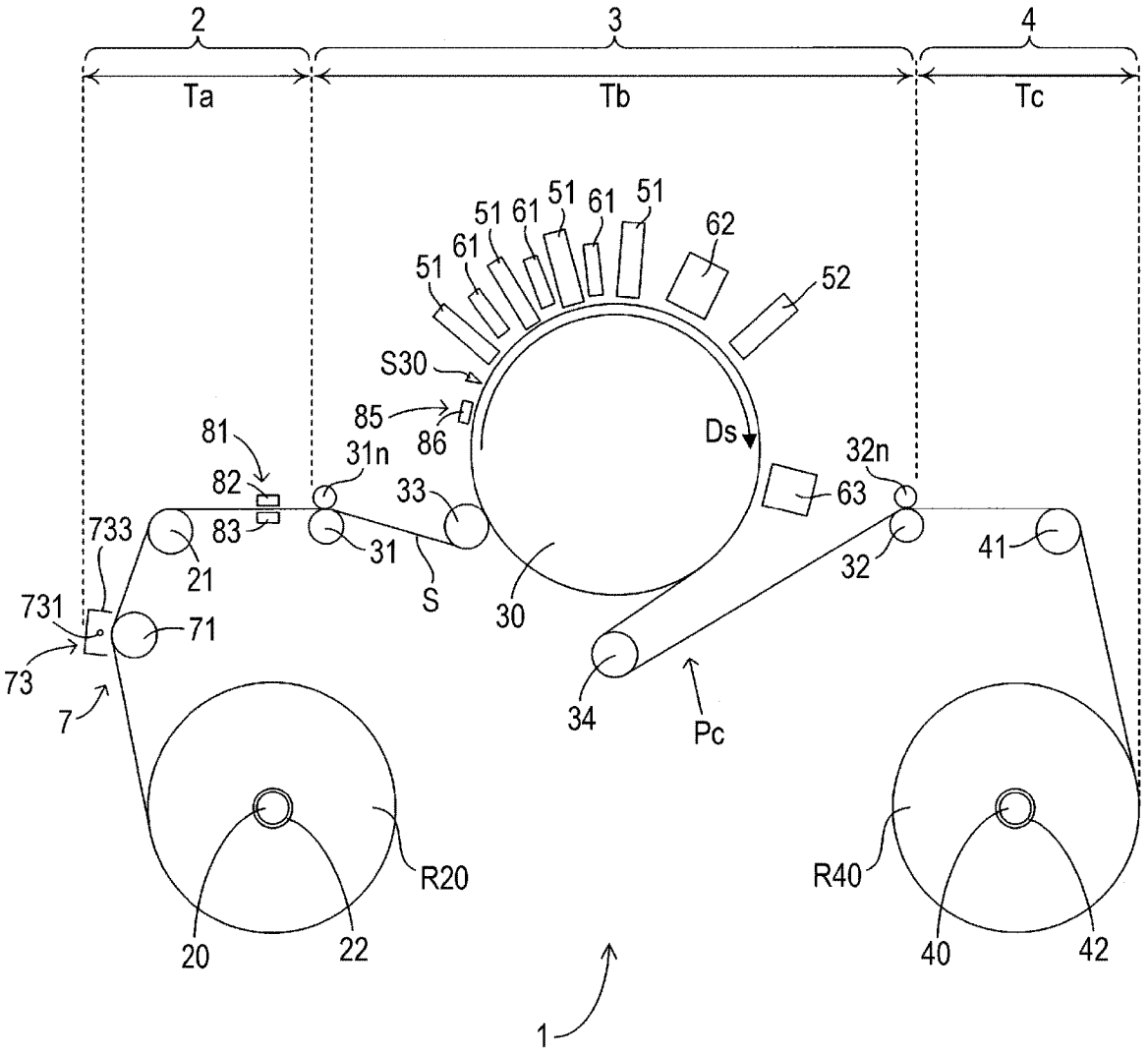
FIG. 1 is a view illustrating an inner configuration of a printer which employs the invention.

FIG. 1 a front view schematically illustrating an example of an inner configuration of a printer which employs the invention. As illustrated in FIG. 1, in a printer 1, one sheet S (web) of which both ends are wound around a delivery shaft 20 and a winding shaft 40 in a rolled shape stretches between the delivery shaft 20 and the winding shaft 40, and the sheet S is transported to the winding shaft 40 from the delivery shaft 20 along a transport path Pc which stretches in this manner. In other words, each of both ends of the sheet S is wound in a rolled shape, a delivery roll R20 and a winding roll R40 are formed, and the sheet S is transported in a roll-to-roll manner along a transport direction Ds toward the winding roll R40 that is pivotally supported by the winding shaft 40 from the delivery roll R20 which is pivotally supported by the delivery shaft 20.

In addition, in the printer 1, an image is recorded on the sheet S transported in the transport direction Ds. The type of the sheet S is broadly classified into a paper type and a film type. Specific examples of the paper type include a pure paper sheet, a cast paper sheet, an art paper sheet, or a coated paper sheet, and specific examples of the film type include a synthetic paper sheet, a polyethylene terephthalate (PET) or a polypropylene (PP). Schematically, the printer 1 includes a delivery portion 2 (delivery region) which delivers the sheet S from the delivery shaft 20, a process portion 3 (process region) which records an image on the sheet S delivered from the delivery portion 2, and a winding portion 4 (winding region) which winds the sheet S on which the image is recorded by the process portion 3 around the winding shaft 40. In addition, in the following description, regarding two surfaces of the sheet S, while a surface on a side that opposes a recording head 51 is referred to as a front surface, a surface on a side reverse thereto is referred to as a rear surface.

The delivery portion 2 includes the delivery shaft 20 around which an end of the sheet S is wound, and a driven roller 21 around which the sheet S pulled out from the delivery shaft 20 is wound. The delivery shaft 20 winds and supports the end of the sheet S in a state where the front surface of the sheet S is toward the outside. In addition, as the delivery shaft 20 rotates in a clockwise direction of FIG. 1, the sheet S wound around the delivery shaft 20 is delivered to the process portion 3 via the driven roller 21. Incidentally, the sheet S is wound around the delivery shaft 20 via a core tube 22 which is attachable to and detachable from the delivery shaft 20. Therefore, when the sheet S of the delivery shaft 20 is used up, a new core tube 22 around which the rolled sheet S is wound is mounted on the delivery shaft 20, and the sheet S of the delivery shaft 20 can be exchanged.

In addition, in the delivery portion 2, a corona treatment device 7 is disposed between the delivery shaft 20 and the driven roller 21 in the transport direction Ds of the sheet S. The corona treatment device 7 includes a supporting roller 71 around which the sheet S that reaches the driven roller 21 from the delivery shaft 20 is wound from a rear surface side, and a corona discharger 73 which opposes the front surface of the supporting roller 71 via the sheet S. The supporting roller 71 is grounded and functions as an earth electrode. Meanwhile, the corona discharger 73 includes a corona discharge electrode 731, and an electrode cover 733 which covers the corona discharge electrode 731. The corona discharge electrode 731 is disposed to oppose the supporting roller 71 via the sheet S, and causes corona discharge between the supporting roller 71 and the corona discharge electrode 731 when receiving voltage application. In this manner, by imparting energy of corona discharge to the front surface of the sheet S wound around the supporting roller 71, the corona treatment (surface modification treatment) is performed with respect to the front surface of the sheet S.

Furthermore, the delivery portion 2 includes a first destaticizing portion 81 provided further on the downstream side in the transport direction Ds than the driven roller 21. The first destaticizing portion 81 includes a front surface ionizer 82 which opposes the front surface of the sheet S, and a rear surface ionizer 83 which opposes the rear surface of the sheet S, and destaticizes the sheet S by the ionizers 82 and 83. In this manner, the delivery portion 2 delivers the sheet S destaticized by the first destaticizing portion 81 to the process portion 3 after receiving the surface modification treatment by the corona treatment device 7.

The process portion 3 records an image on the sheet S by appropriately performing the treatment by each of the functional portions 51, 52, 61, 62, and 63 which are disposed along the outer circumferential surface of a rotation drum 30 while supporting the sheet S delivered from the delivery portion 2 by the rotation drum 30. In the process portion 3, a infeed roller 31 and a outfeed roller 32 are provided on both sides of the rotation drum 30, the sheet S transported to the outfeed roller 32 from the infeed roller 31 is supported by the rotation drum 30 and receives the image recording.

The infeed roller 31 has a plurality of fine projections formed by thermal spraying on an outer circumferential surface, and supports the sheet S delivered from the delivery portion 2 from the rear surface side. In addition, the infeed roller 31 transports the sheet S delivered from the delivery portion 2 to the downstream side in the transport direction Ds by rotation thereof in a clockwise direction of FIG. 1. In addition, a nip roller 31*n* is provided with respect to the infeed roller 31. The nip roller 31*n* abuts against the front surface of the sheet S in a state of being biased to the infeed roller 31 side, and nips the sheet S between the nip roller 31*n* and the infeed roller 31. According to this, a friction force is ensured between the infeed roller 31 and the sheet S, and it is possible to reliably transport the sheet S by the infeed roller 31.

The rotation drum 30 is, for example, a cylindrical drum which is supported to be rotatable by a supporting mechanism that is not illustrated, and has a diameter of 400 [mm], and the sheet S transported to the outfeed roller 32 from the infeed roller 31 is wound from the rear surface side. The rotation drum 30 supports the sheet S from the rear surface side while rotating to be driven in the transport direction Ds of the sheet S by receiving the friction force between the rotation drum 30 and the sheet S. In other words, in the process portion 3, driven rollers 33 and 34 which fold back the sheet S on both sides of a winding portion to the rotation drum 30 are provided. The driven roller 33 of the driven rollers folds back the sheet S by winding the front surface of the sheet S between the infeed roller 31 and the rotation drum 30. Meanwhile, the driven roller 34 folds back the sheet S by winding the front surface of the sheet S between the rotation drum 30 and the outfeed roller 32. In this manner, by folding back the sheet S on each of the upstream side and the downstream side in the transport direction Ds with respect to the rotation drum 30, it is possible to ensure the winding portion of the sheet S to the rotation drum 30 to be long.

The outfeed roller 32 includes a plurality of fine projections formed by thermal spraying on an outer circumferential surface, and supports the sheet S transported via the driven roller 34 from the rotation drum 30, from the rear surface side. In addition, the outfeed roller 32 transports the sheet S to the winding portion 4 by rotation thereof in a clockwise direction of FIG. 1. In addition, a nip roller 32*n* is provided with respect to the outfeed roller 32. The nip roller 32*n* abuts against the front surface of the sheet S in a state of being biased to the outfeed roller 32 side, and nips the sheet S between the nip roller 32*n* and the outfeed roller 32. According to this, a friction force is ensured between the outfeed roller 32 and the sheet S, and it is possible to reliably transport the sheet S by the outfeed roller 32.

In this manner, the sheet S transported to the outfeed roller 32 from the infeed roller 31 is supported on the outer circumferential surface of the rotation drum 30. In addition, in the process portion 3, in order to record a color image on the front surface of the sheet S supported by the rotation drum 30, the plurality of recording heads 51 which correspond to colors different from each other are provided. Specifically, four recording heads 51 which correspond to yellow, cyan, magenta, and black are aligned in the transport direction Ds in this color order. Each of the recording heads 51 opposes the front surface of the sheet S wound around the rotation drum 30 at a slight clearance, and discharges ink having a corresponding color (color ink) from a nozzle in an ink jet method. In addition, as each of the recording heads 51 discharges the ink to the sheet S transported in the transport direction Ds, a color image is formed on the front surface of the sheet S.

Incidentally, as ink, ultraviolet (UV) ink (photo-curing ink) which is cured by being irradiated with an ultraviolet ray (light) is used. Here, in the process portion 3, in order to fix the ink to the sheet S by curing the ink, UV irradiators 61 and 62 (light irradiating portion) are provided. In addition, the ink curing is performed by dividing the process into two steps including temporary curing and main curing. Between each of the plurality of recording heads 51, the UV irradiator 61 for the temporary curing is disposed. In other words, by irradiating the ultraviolet ray having a small accumulated amount of light, the UV irradiator 61 cures (temporarily cures) the ink to the extent that the shape of the ink does not collapse, and does not completely cure the ink. Meanwhile, on the downstream side in the transport direction Ds with respect to the plurality of recording heads 51, the UV irradiator 62 for the main curing is provided. In other words, by irradiating the ultraviolet ray having a large accumulated amount of light by the UV irradiator 61, the UV irradiator 62 completely cures (mainly cures) the ink.

In this manner, the UV irradiator 61 disposed between each of the plurality of recording heads 51 temporarily cures the color ink discharged to the sheet S from the recording head 51 that is on the upstream side in the transport direction Ds. Therefore, the ink discharged to the sheet S by one recording head 51 is temporarily cured until reaching the recording head 51 adjacent to the one recording head 51 that is on the downstream side in the transport direction Ds. Accordingly, generation of mixed color which is mixing of ink having different colors is suppressed. In a state where the mixed color is suppressed in this manner, the plurality of recording heads 51 discharge different colors of ink, and form a color image on the sheet S. Furthermore, further on the downstream side in the transport direction Ds than the plurality of recording heads 51, the UV irradiator 62 for the main curing is provided. Therefore, the color image formed by the plurality of recording heads 51 is mainly cured by the UV irradiator 62, and is fixed to the sheet S.

Furthermore, on the downstream side in the transport direction Ds with respect to the UV irradiator 62, the recording head 52 is also provided. The recording head 52 opposes the front surface of the sheet S wound around the rotation drum 30 at a slight clearance, and discharges transparent UV ink from the nozzle to the front surface of the sheet S in the ink jet method. In other words, the transparent ink is further discharged to the color image formed by the recording heads 51 for four colors. The transparent ink is discharged to the entire surface of the color image, and imparts texture, such as glossy sense or matt sense, to the color image. In addition, on the downstream side in the transport direction Ds with respect to the recording head 52, the UV irradiator 63 is provided. As a strong ultraviolet ray is irradiated, the UV irradiator 63 completely cures (mainly cures) the transparent ink discharged by the recording head 52. According to this, it is possible to fix the transparent ink to the front surface of the sheet S.

However, in the printer 1 which records an image on the sheet S by discharging the ink from the recording heads 51 and 52 in this manner, when an electrification amount of the sheet S is large, there is a tendency for a large amount of mist-like ink to be fixed to the surface which opposes the sheet S in the recording heads 51 and 52. As described above, since the first destaticizing portion 81 is provided in the delivery portion 2, electrification of the sheet S is suppressed to a certain extent. However, in the process portion 3, in order to more reliably suppress adhesion of mist-like ink to the recording heads 51 and 52, a second destaticizing portion 85 is provided. The second destaticizing portion 85 includes a front surface ionizer 86 which opposes the front surface of the sheet S further on the upstream side than the uppermost recording head 51 in the transport direction Ds (that is, between the driven roller 33 and the uppermost recording head 51 in the transport direction Ds). In addition, the sheet S is destaticized by the front surface ionizer 86. Furthermore, in the process portion 3, in order to efficiently confirm destaticization of the sheet S, a potential sensor S30 which detects a potential of the front surface of the sheet S is provided. The rotation drum 30 detects the potential of the front surface of the sheet S wound around the rotation drum 30 between the second destaticizing portion 85 and the uppermost recording head 51 in the transport direction Ds.

In this manner, in the process portion 3, the discharge and the curing of the ink are appropriately performed with respect to the sheet S wound around the outer circumferential portion of the rotation drum 30, and the color image coated with the transparent ink is formed. At this time, the sheet S which receives the printing of the color image in the process portion 3 receives the surface modification treatment in advance before reaching parts that oppose the recording heads 51 and 52. Since the color image is formed by discharging the ink to the sheet S to which the surface modification treatment is performed in this manner, it is possible to form a color image having a high quality. In addition, the sheet S is destaticized before reaching parts that oppose the recording heads 51 and 52. Therefore, it is possible to form the color image on the sheet S while suppressing the fixing of a large amount of mist-like ink to the recording heads 51 and 52 since an electrification amount of the sheet S is large. In addition, the sheet S on which the color image is formed is transported to the winding portion 4 by the outfeed roller 32.

In addition to the winding shaft 40 around which the end of the sheet S is wound, the winding portion 4 includes a driven roller 41 which winds the sheet S from the rear surface side between the winding shaft 40 and the outfeed roller 32. In a state where the front surface of the sheet S is oriented to the outside, the winding shaft 40 winds and supports the end of the sheet S. In other words, when the winding shaft 40 rotates in a clockwise direction of FIG. 1, the sheet S transported from the outfeed roller 32 is wound around the winding shaft 40 via the driven roller 41. Incidentally, the sheet S is wound around the winding shaft 40 via a core tube 42 which is attachable to and detachable from the winding shaft 40. Therefore, when the sheet S wound around the winding shaft 40 is full, it is possible to detach the sheet S from each core tube 42.

Figure 2:
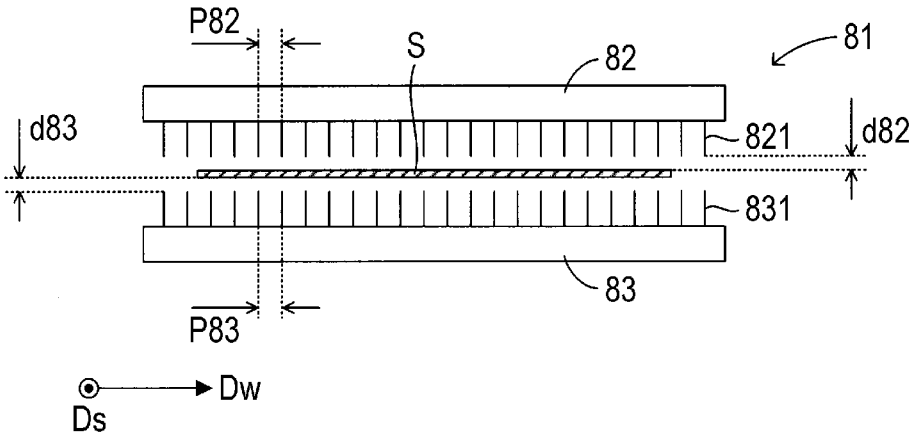
FIG. 2 is a view illustrating a configuration of a first destaticizing portion.
Figure 3:
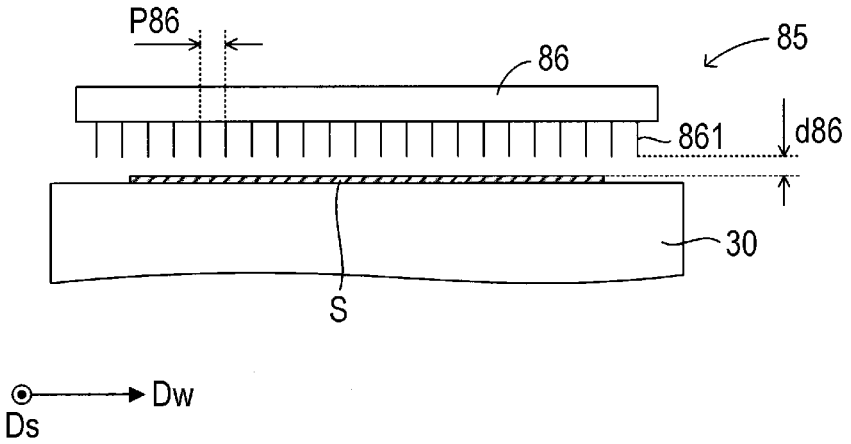
FIG. 3 is a view illustrating a configuration of a second destaticizing portion.

However, as described above, the printer 1 includes the first destaticizing portion 81 disposed in the delivery portion 2, and the second destaticizing portion 85 disposed in the process portion 3. Next, a configuration of the first and second destaticizing portions 81 and 85 will be described. FIG. 2 is a view schematically illustrating a configuration of the first destaticizing portion, and FIG. 3 is a view schematically illustrating a configuration of the second destaticizing portion. In addition, the sheet S is also written in addition to the first destaticizing portion 81 in FIG. 2, and the sheet S and the rotation drum 30 are also written in addition to the second destaticizing portion 85 in FIG. 3. In addition, a width direction Dw illustrated in both drawings is a direction which is orthogonal to the transport direction Ds and is parallel to the front surface of the rotation drum 30, that is, is a direction which is parallel to a rotation shaft of the rotation drum 30.

As illustrated in FIG. 2, the first destaticizing portion 81 includes the front surface ionizer 82 disposed on the front surface side of the sheet S, and the rear surface ionizer 83 disposed on the rear surface side of the sheet S. In the front surface ionizer 82, a plurality of discharge needles 821 which oppose the front surface of the sheet S at an interval d82 are arranged in a row at an equivalent pitch P82 to be parallel to the width direction Dw. In addition, in the rear surface ionizer 83, a plurality of discharge needles 831 which oppose the rear surface of the sheet S at an interval d83 are aligned in a row at an equivalent pitch P83 to be parallel to the width direction Dw. Here, the interval d82 and the interval d83 are equivalent to each other, and the pitch P82 and the pitch P83 are equivalent to each other. In addition, the front surface ionizer 82 and the rear surface ionizer 83 are alternately positioned such that one discharge needle 821 and one discharge needle 831 oppose each other nipping the sheet S. In addition, the front surface ionizer 82 and the rear surface ionizer 83 are positioned with respect to the transport path Pc of the sheet S such that the row of the plurality of discharge needles 821 and the row of the plurality of discharge needles 831 protrude further to both sides in the width direction Dw than the sheet S.

As illustrated in FIG. 3, the second destaticizing portion 85 includes the front surface ionizer 86 disposed on the front surface side of the sheet S. In the front surface ionizer 86, the plurality of discharge needles 861 which oppose the front surface of the sheet S at an interval d86 are aligned in a row at an equivalent pitch P86 to be parallel to the width direction Dw. Here, the interval d86 is wider than the interval d82 and the interval d83 (d86>d82=d83), and the pitch P86 is greater than the pitch P82 and the pitch P83 (P86>P82=P83). The front surface ionizer 86 is positioned with respect to the transport path Pc of the sheet S such that the row of the plurality of discharge needles 861 protrudes further to both sides in the width direction Dw than the sheet S. In addition, the rotation drum 30 is positioned to protrude further to both sides in the width direction Dw than the row of the plurality of discharge needles 861 and the sheet S. Incidentally, the entire region of the front surface (circumferential surface) of the rotation drum 30 is covered with a black insulating layer formed by alumite treatment. Therefore, parts on both sides of the sheet S which protrude to the discharge needle 861 are covered with the insulating layer without being covered by the sheet S on the front surface of the rotation drum 30.

Figure 4:
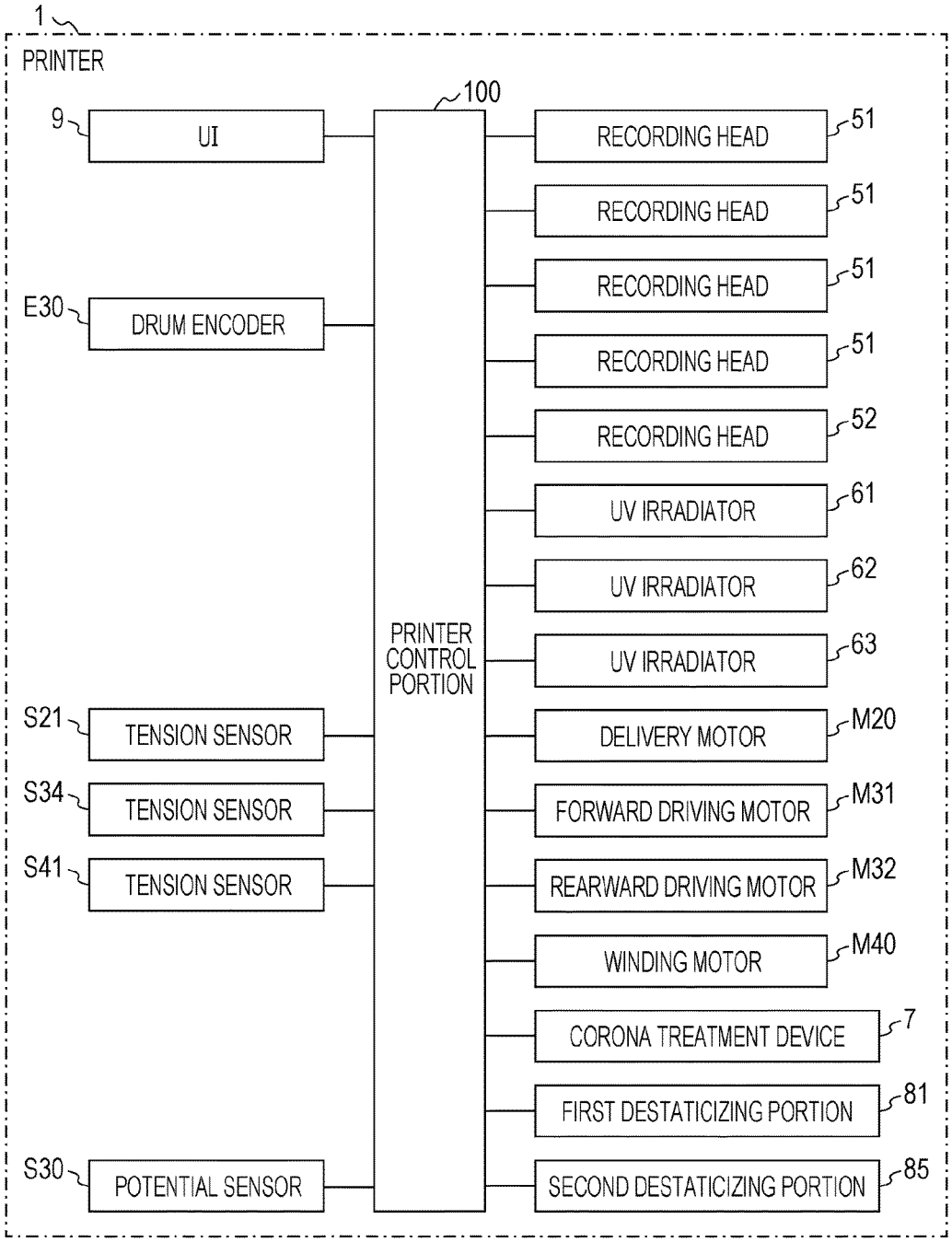
FIG. 4 is a view illustrating an electric configuration which controls the printer.

The description above is an outline of the apparatus configuration of the printer 1. Next, an electric configuration which controls the printer 1 will be described. FIG. 4 is a block diagram illustrating the electric configuration which controls the printer illustrated in FIG. 1. The printer 1 includes a printer control portion 100 which integrally controls each portion of the apparatus. The printer control portion 100 is a computer configured of a central processing unit (CPU) or a memory.

In addition, the printer 1 includes a user interface (UI) 9. The UI 9 includes a monitor configured of a liquid crystal display or the like, and an input operation portion configured of a keyboard or a mouse. In addition, on the monitor of the UI 9, a menu screen is displayed in addition to the image of a printing target. Therefore, the user can open a printing setting screen from the menu screen, and set various printing conditions, such as a type of a printing medium, the size of the printing medium, and printing quality, by operating the input operation portion of the UI 9 while confirming the monitor of the UI 9. In addition, a specific configuration of the UI 9 can be modified in a various manners, and for example, the input operation portion may be configured of a touch panel of the monitor by using a touch panel type display as a monitor. In addition, the printer control portion 100 controls each portion of the apparatus of the recording head, the UV irradiator, and a sheet transport system as follows in accordance with a command from an external apparatus or an input operation of the UI 9.

The printer control portion 100 controls an ink discharge timing of each of the recording heads 51 which form the color image in accordance with the transport of the sheet S. Specifically, the control of the ink discharge timing is performed based on an output (detected value) of a drum encoder E30 which is attached to the rotation shaft of the rotation drum 30 and detects a rotation position of the rotation drum 30. In other words, in order to allow the rotation drum 30 to rotate to be driven according to the transport of the sheet S, it is possible to grasp a transport position of the sheet S with reference to the output of the drum encoder E30 that detects the rotation position of the rotation drum 30. Here, as the printer control portion 100 generates a print timing signal (pts) signal from the output of the drum encoder E30, and controls the ink discharge timing of each of the recording heads 51 based on the pts signal, the ink discharged by each of the recording heads 51 lands at a target position of the transported sheet S, and the color image is formed.

In addition, the timing at which the recording head 52 discharges the transparent ink is also similarly controlled by the printer control portion 100 based on the output of the drum encoder E30. According to this, it is possible to accurately discharge the transparent ink to the color image formed by the plurality of the recording heads 51. Furthermore, a timing of turning on and off or the irradiation amount of the UV irradiators 61, 62, and 63, is also controlled by the printer control portion 100.

In addition, the printer control portion 100 administers a function of controlling the transport of the sheet S described in detail by using FIG. 1. In other words, motors are connected to each of the delivery shaft 20, the infeed roller 31, the outfeed roller 32, and the winding shaft 40, among the members which configure the sheet transport system. In addition, the printer control portion 100 controls a speed or torque of each motor and controls the transport of the sheet S while rotating the motors. The transport control of the sheet S will be described in detail as follows.

The printer control portion 100 rotates a delivery motor M20 which drives the delivery shaft 20, and supplies the sheet S to the infeed roller 31 from the delivery shaft 20. At this time, the printer control portion 100 controls torque of the delivery motor M20, and adjusts tension (delivery tension Ta) of the sheet S to the infeed roller 31 from the delivery shaft 20. In other words, a tension sensor S21 which detects the delivery tension Ta is attached to the driven roller 21 disposed between the delivery shaft 20 and the infeed roller 31. The tension sensor S21 can be configured of, for example, a load cell which detects a force received from the sheet S. In addition, the printer control portion 100 feedback-controls the torque of the delivery motor M20, and adjusts the delivery tension Ta of the sheet S based on the detection result of the tension sensor S21.

In addition, the printer control portion 100 rotates a forward driving motor M31 which drives the infeed roller 31, and a rearward driving motor M32 which drives the outfeed roller 32. Accordingly, the sheet S delivered from the delivery portion 2 passes through the process portion 3. At this time, while a speed control is performed with respect to the forward driving motor M31, a torque control is performed with respect to the rearward driving motor M32. In other words, the printer control portion 100 adjusts the rotation speed of the forward driving motor M31 based on the output of the encoder of the forward driving motor M31. According to this, the sheet S is transported at a constant speed by the infeed roller 31.

Meanwhile, the printer control portion 100 controls the torque of the rearward driving motor M32, and adjusts tension (process tension Tb) of the sheet S from the infeed roller 31 to the outfeed roller 32. In other words, a tension sensor S34 which detects the process tension Tb is attached to a driven roller 34 disposed between the rotation drum 30 and the outfeed roller 32. The tension sensor S34 can be configured of, for example, a load cell which detects a force received from the sheet S. In addition, the printer control portion 100 feedback-controls the torque of the rearward driving motor M32, and adjusts the process tension Tb of the sheet S based on the detection result of the tension sensor S34.

In addition, the printer control portion 100 rotates a winding motor M40 which drives the winding shaft 40, and winds the sheet S transported by the outfeed roller 32 around the winding shaft 40. At this time, the printer control portion 100 controls torque of the winding motor M40, and adjusts the tension (winding tension Tc) of the sheet S to the winding shaft 40 from the outfeed roller 32. In other words, a tension sensor S41 which detects the winding tension Tc is attached to the driven roller 41 disposed between the outfeed roller 32 and the winding shaft 40. The tension sensor S41 can be configured of, for example, a load cell which detects a force received from the sheet S. In addition, the printer control portion 100 feedback-controls the torque of the winding motor M40, and adjusts the winding tension Tc of the sheet S based on the detection result of the tension sensor S41.

In addition, the printer control portion 100 administers a function of controlling the corona treatment device 7. Specifically, the printer control portion 100 adjusts a voltage supplied to the corona discharge electrode 731 provided with the corona discharger 73. According to this, it is possible to adjust energy supplied for corona treatment, and to optimize wettability of the ink with respect to the sheet S.

Furthermore, the printer control portion 100 optimizes destaticizing processing to the sheet S by controlling the first destaticizing portion 81 and the second destaticizing portion 85. In particular, in the first control example of the destaticizing processing which will be described later, the printer control portion 100 controls the first destaticizing portion 81 and the second destaticizing portion 85 based on a result of detecting the front surface potential of the sheet S by the drum encoder E30.

Figure 5:
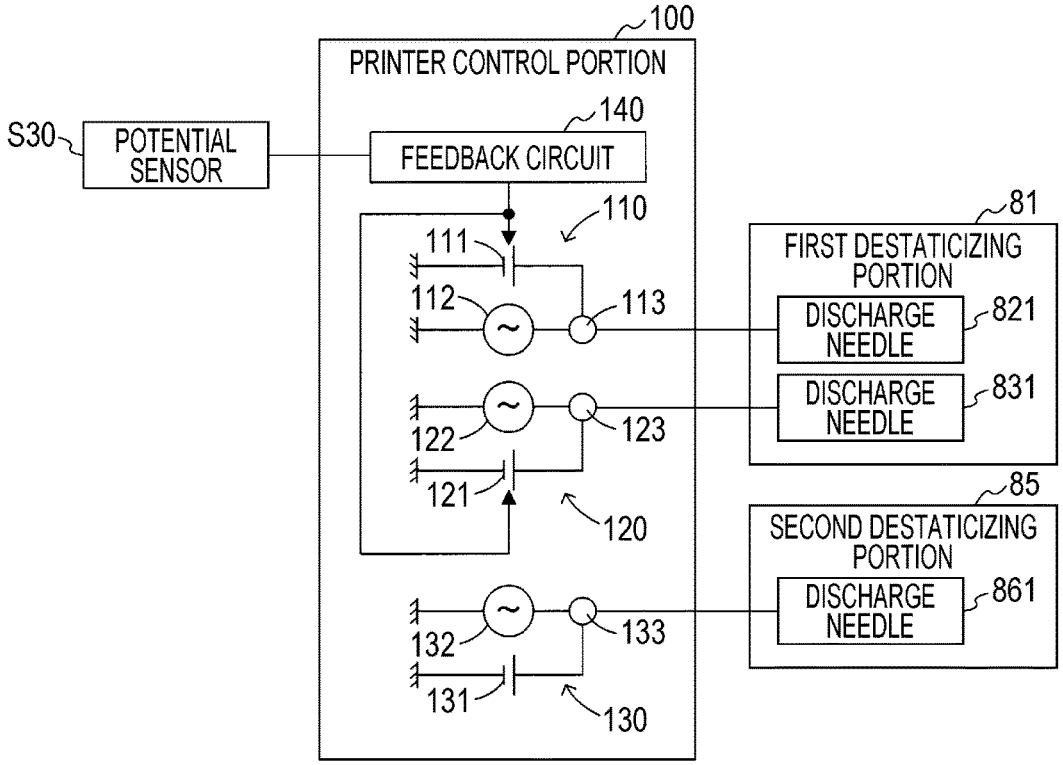
FIG. 5 is a view illustrating a configuration in which a first control example of destaticizing processing of a sheet is performed.

FIG. 5 is a block diagram illustrating a configuration in which the first control example of destaticizing processing of the sheet is performed. As illustrated in FIG. 5, the printer control portion 100 includes a power source portion 110 which supplies a voltage to each of the discharge needles 821 included in the front surface ionizer 82 of the first destaticizing portion 81, a power source portion 120 which supplies a voltage to each of the discharge needles 831 included in the rear surface ionizer 83 of the first destaticizing portion 81, and a power source portion 130 which supplies a voltage to each of the discharge needles 861 included in the front surface ionizer 86 of the second destaticizing portion 85.

The power source portion 110 includes a DC power source 111, an AC power source 112, and an amplifier 113 which adds an output of the AC power source 112 to an output of the DC power source 111, and supplies an output voltage of the amplifier 113 to the discharge needle 821 of the first destaticizing portion 81. According to this, the output voltage of the DC power source 111 is imparted as a bias voltage, and an AC voltage output by the AC power source 112 is imparted focusing on the bias voltage, with respect to the discharge needle 821. Accordingly, the discharge needle 821 alternately and periodically emits positive ions and negative ions in accordance with the supply of the AC voltage which vibrates considering (focusing on) the bias voltage as a reference.

The power source portion 120 includes a DC power source 121, an AC power source 122, and an amplifier 123 which adds an output of the AC power source 122 to an output of the DC power source 121, and supplies an output voltage of the amplifier 123 to the discharge needle 831 of the first destaticizing portion 81. According to this, the output voltage of the DC power source 121 is imparted as a bias voltage, and an AC voltage output by the AC power source 122 is imparted focusing on the bias voltage, with respect to the discharge needle 831. Accordingly, the discharge needle 831 alternately and periodically emits positive ions and negative ions in accordance with the supply of the AC voltage which vibrates considering (focusing on) the bias voltage as a reference.

At this time, the discharge needle 821 and the discharge needle 831 are biased to the same DC voltage to be equivalent to the DC voltage output by the DC power source 111 and the DC voltage output by the DC power source 121. In addition, the AC voltage output by the AC power source 112 and the AC voltage output by the AC power source 122 have amplitudes and frequencies which are equivalent to each other. However, a phase of the AC voltage output by the AC power source 112 is different from a phase of the AC voltage output by the AC power source 122 by 180 degrees. According to this, voltages reverse to each other are supplied to each of the discharge needle 821 and the discharge needle 831 focusing on the bias voltage. As a result, it is possible to efficiently supply ions emitted from each of the discharge needles 821 and 831 of the first destaticizing portion 81 to the sheet S.

The power source portion 130 includes a DC power source 131, an AC power source 132, and an amplifier 133 which adds an output of the AC power source 132 to an output of the DC power source 131, and supplies an output voltage of the amplifier 133 to the discharge needle 861 of the second destaticizing portion 85. According to this, the output voltage of the DC power source 131 is imparted as a bias voltage, and an AC voltage output by the AC power source 132 is imparted focusing on the bias voltage, with respect to the discharge needle 861. Accordingly, the discharge needle 861 alternately and periodically emits positive ions and negative ions in accordance with the supply of the AC voltage which vibrates considering (focusing on) the bias voltage as a reference. In addition, in the example, the amplitude of the AC voltage output by the AC power source 132 is set to be 1 times or greater and less than 2 times the amplitude of the AC voltage output by the AC power source 112 and the AC power source 122.

Furthermore, the printer control portion 100 includes a feedback circuit 140, and the feedback circuit 140 feedback-controls the output voltage of the DC power sources 111 and 121 of each of the power source portions 110 and 120 based on the detected value of the potential sensor S30, that is, the bias voltage of the discharge needles 821 and 831. Specifically, the output voltage of the DC power sources 111 and 121 is feedback-controlled such that the voltage detected by the potential sensor S30 becomes close to a ground potential. According to this, an ion balance of the first destaticizing portion 81 is adjusted.

Figure 6:
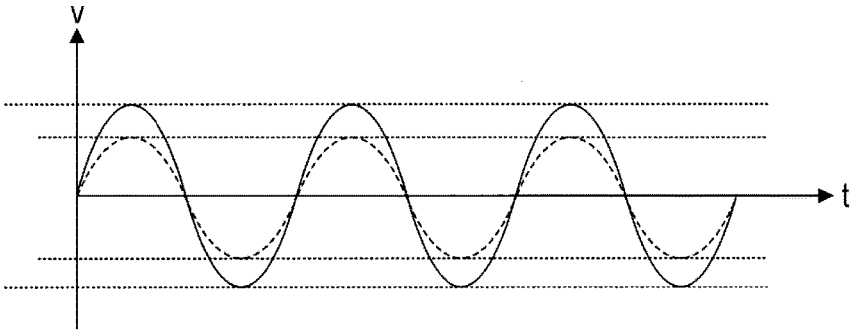
FIG. 6 is a view illustrating a temporal change in voltage generated by the first and second destaticizing portions on the sheet.

FIG. 6 is a view schematically illustrating a temporal change in voltage generated by the first destaticizing portion and second destaticizing portion on the sheet. In FIG. 6, a horizontal axis indicates time t, and a vertical axis indicates voltage V. In addition, a curve illustrated by a solid line indicates a change in voltage generated by the first destaticizing portion 81 on the sheet S, and a curve illustrated by a broken line indicates a change in voltage generated by the second destaticizing portion 85 on the sheet S. In addition, the former change in voltage may be acquired by measuring the change in voltage on the sheet S at a part nipped by the front surface ionizer 82 and the rear surface ionizer 83, or may be calculated from the change in voltage of tip ends of each of the discharge needle 821 and the discharge needle 831 from the intervals d82 and d83. In addition, the latter change in voltage may be acquired by measuring the change in voltage on the sheet S at a part which opposes the front surface ionizer 86, or may be calculated from the change in voltage of the tip end of the discharge needle 861 and the interval d86. The AC power source 112 sets the AC power source and the amplitude of the AC voltage output by the AC power source 132 as described above, and as a result, as illustrated in the drawing, the amplitude of the AC voltage generated on the sheet S by the first destaticizing portion 81 is greater than the amplitude of the AC voltage generated on the sheet S by the second destaticizing portion 85.

As described above, in the embodiment, the sheet S is destaticized by the first destaticizing portion 81 further on the upstream side in the transport direction Ds than the infeed roller 31 which drives the sheet S in the transport direction Ds. Therefore, since the sheet S is destaticized when passing through the infeed roller 31, sticking of the sheet S to the infeed roller 31 is suppressed. As a result, it is possible to accurately detect the process tension Tb of the sheet S in the process portion 3 further on the downstream side in the transport direction Ds than the infeed roller 31, and to appropriately perform the control of the process tension Tb of the sheet S. In particular, the process tension Tb of the sheet S from the infeed roller 31 to the outfeed roller 32 is tension of the sheet S which receives the discharge of the ink from the recording heads 51 and 52 on the circumferential surface of the rotation drum 30. Therefore, from the viewpoint of excellent image recording, the process tension Tb becomes more important than other tensions Ta and Tc. Therefore, the embodiment which can appropriately perform the control of the process tension Tb is extremely appropriate.

In addition, the corona treatment device 7 which performs surface modification treatment is provided on the sheet S by imparting discharge energy to the sheet S further on the upstream side in the transport direction Ds than the first destaticizing portion 81. In the printer 1 provided in the corona treatment device 7, since there is a tendency for an electrification amount of the sheet S to increase, influence on the tension control due to the sticking of the electrified sheet S to the infeed roller 31 also increases. Meanwhile, by destaticizing the sheet S by the first destaticizing portion 81 further on the upstream side in the transport direction Ds than the infeed roller 31, it is possible to appropriately perform the tension control of the sheet S.

In addition, the second destaticizing portion 85 which destaticizes the sheet S is provided between the infeed roller 31 and the uppermost recording head 51 in the transport direction Ds. In this manner, by destaticizing the sheet S in two steps until reaching the recording head 51, it is possible to suppress adhesion of mist-like ink to the recording head 51 due to the destaticization of the sheet S by definitely destaticizing the sheet S.

However, the second destaticizing portion 85 is provided to oppose the rotation drum 30. According to this, it is possible to destaticize the sheet S in the vicinity of the recording head 51, and to efficiently suppress adhesion of mist-like ink to the recording head 51 due to the destaticization of the sheet S.

In addition, in the above-described embodiment, the front surface of the rotation drum 30 is covered with the insulating layer. The reason thereof is as follows. In other words, in a case where the front surface of the rotation drum 30 has conductivity, there is a concern that ions generated by the second destaticizing portion 85 are oriented toward a part which is not hidden on the sheet S on the front surface of the rotation drum 30, and the ions cannot be definitely imparted to the sheet S. Meanwhile, in the embodiment, by covering the front surface of the rotation drum 30 with the insulating layer, it is possible to definitely impart the ions generated by the second destaticizing portion 85 to the sheet S, and to more reliably destaticize the sheet S.

However, above, the first destaticizing portion 81 disposed on the upstream side and the second destaticizing portion 85 disposed on the downstream side are provided in the transport direction Ds of the sheet S. In addition, the AC voltage having a relatively large amplitude is generated on the sheet S due to the AC voltage applied to the discharge needles 821 and 831 of the first destaticizing portion 81. Therefore, there is a tendency for ions to be concentrated and imparted to the sheet S at a part at which the discharge needles 821 and 831 oppose each other. As a result, a large difference in applying amount of ions between a part at which the ions are tightly imparted and a part at which the ions are sparsely imparted is generated, and uneven destaticization is likely to be generated on the sheet S destaticized by the first destaticizing portion 81. Meanwhile, in the embodiment, the second destaticizing portion 85 further destaticizes the sheet S after the destaticization by the first destaticizing portion 81. However, as illustrated in FIG. 6, the amplitude of the AC voltage generated on the sheet S by the AC voltage applied to the discharge needle 861 of the second destaticizing portion 85 is smaller than the amplitude of the AC voltage generated on the sheet S by the AC voltage applied to the discharge needles 821 and 831 of the first destaticizing portion 81. Therefore, the second destaticizing portion 85 can similarly destaticize the sheet S compared to the first destaticizing portion 81, and it is possible to mitigate uneven destaticization of the sheet S after the destaticization by the first destaticizing portion 81. As a result, it is possible to suppress adhesion of mist-like liquid to the recording head 51.

At this time, the first destaticizing portion 81 includes the plurality of discharge needles 821 provided on the front surface side of the sheet S, and the plurality of discharge needles 831 provided on the rear surface side of the sheet S, and the phase of the AC voltage applied to the plurality of discharge needles 821 on the front surface side is different from the phase of the AC voltage applied to the plurality of discharge needles 831 on the rear surface side by 180 degrees. In the configuration, the AC voltage having a relatively large amplitude is generated on the sheet S by the AC voltage applied to the discharge needles 821 and 831 of the first destaticizing portion 81. Here, it is appropriate to mitigate uneven destaticization of the sheet S after the destaticization by the first destaticizing portion 81 by providing the second destaticizing portion 85 as described above.

In addition, the intervals d82 and d83 between the discharge needles 821 and 831 of the first destaticizing portion 81 and the sheet S are narrower than the interval d86 between the discharge needle 861 of the second destaticizing portion 85 and the sheet S. In the configuration, the AC voltage having a relatively large amplitude is generated on the sheet S by the AC voltage applied to the discharge needles 821 and 831 of the first destaticizing portion 81. Here, as described above, it is appropriate to mitigate uneven destaticization of the sheet S after the destaticization by the first destaticizing portion 81 by providing the second destaticizing portion 85.

In addition, the pitches P82 and P83 at which the plurality of discharge needles 821 and 831 are arranged in the first destaticizing portion 81 are different from the pitch P86 at which the plurality of discharge needles 861 are arranged in the second destaticizing portion 85. In this manner, by making the pitches P82, P83, and P86 at which the discharge needles 821, 831, and 861 are arranged different in the first destaticizing portion 81 and in the second destaticizing portion 85, it is possible to more efficiently mitigate uneven destaticization of the sheet S after the destaticization by the first destaticizing portion 81 by the second destaticizing portion 85.

In addition, the DC power sources 111 and 121 which adjust the ion balance of the first destaticizing portion 81, and the potential sensor S30 which detects the potential of the sheet S supported by the rotation drum 30 are provided. In the configuration, it is possible to adjust the ion balance of the first destaticizing portion 81 while confirming the detection result of the potential of the sheet S supported by the rotation drum 30. Therefore, it is possible to optimize the ion balance. As a result, it is possible to suppress the adhesion of mist-like liquid to the recording head 51.

In particular, the feedback circuit 140 which controls the ion balance of the first destaticizing portion 81 is provided by adjusting the ion balance of the first destaticizing portion 81 to the DC power sources 111 and 121 based on the detection result of the potential sensor S30. In the configuration, it is possible to automatically optimize the ion balance by the feedback circuit 140.

As described above, in the above-described embodiment, the printer 1 corresponds to an example of "printing apparatus" of the invention, the infeed roller 31 corresponds to an example of "driving roller" of the invention, the rotation drum 30 corresponds to an example of "supporting member" of the invention, the recording heads 51 and 52 correspond to an example of "discharge head" of the invention, the printer control portion 100, the tension sensor S34, the outfeed roller 32, and the rearward driving motor M32 cooperate with each other and function as an example of "tension control portion" of the invention, the first destaticizing portion 81 corresponds to an example of "first destaticizing portion" of the invention, the sheet S corresponds to an example of "recording medium" of the invention, the transport direction Ds corresponds to an example of "predetermined direction" of the invention, and the process tension Tb corresponds to an example of "tension" of the invention. In addition, the corona treatment device 7 corresponds an example of "discharger" of the invention, the second destaticizing portion 85 corresponds to an example of "second destaticizing portion" of the invention, the discharge needle 821 and the discharge needle 831 correspond to an example of "electrode" of "first destaticizing portion" of the invention, the discharge needle 861 corresponds to an example of "electrode" of "second destaticizing portion" of the invention, the interval d82 and the interval d83 correspond to an example of "interval between the electrode of the first destaticizing portion and the recording medium" of the invention, the interval d86 corresponds to an example of "interval between the electrode of the second destaticizing portion and the recording medium" of the invention, the pitch P82 and the pitch P83 correspond to an example of "pitch at which the plurality of electrodes are arranged in the first destaticizing portion" of the invention, the pitch P86 corresponds to an example of "pitch at which the plurality of electrodes are arranged in the second destaticizing portion" of the invention, the DC power source 111 and the DC power source 121 correspond to an example of "adjustment portion" of the invention, the potential sensor S30 corresponds to an example of "potential detection portion" of the invention, and the feedback circuit 140 corresponds to an example of "balance control portion" of the invention.

Figure 7:
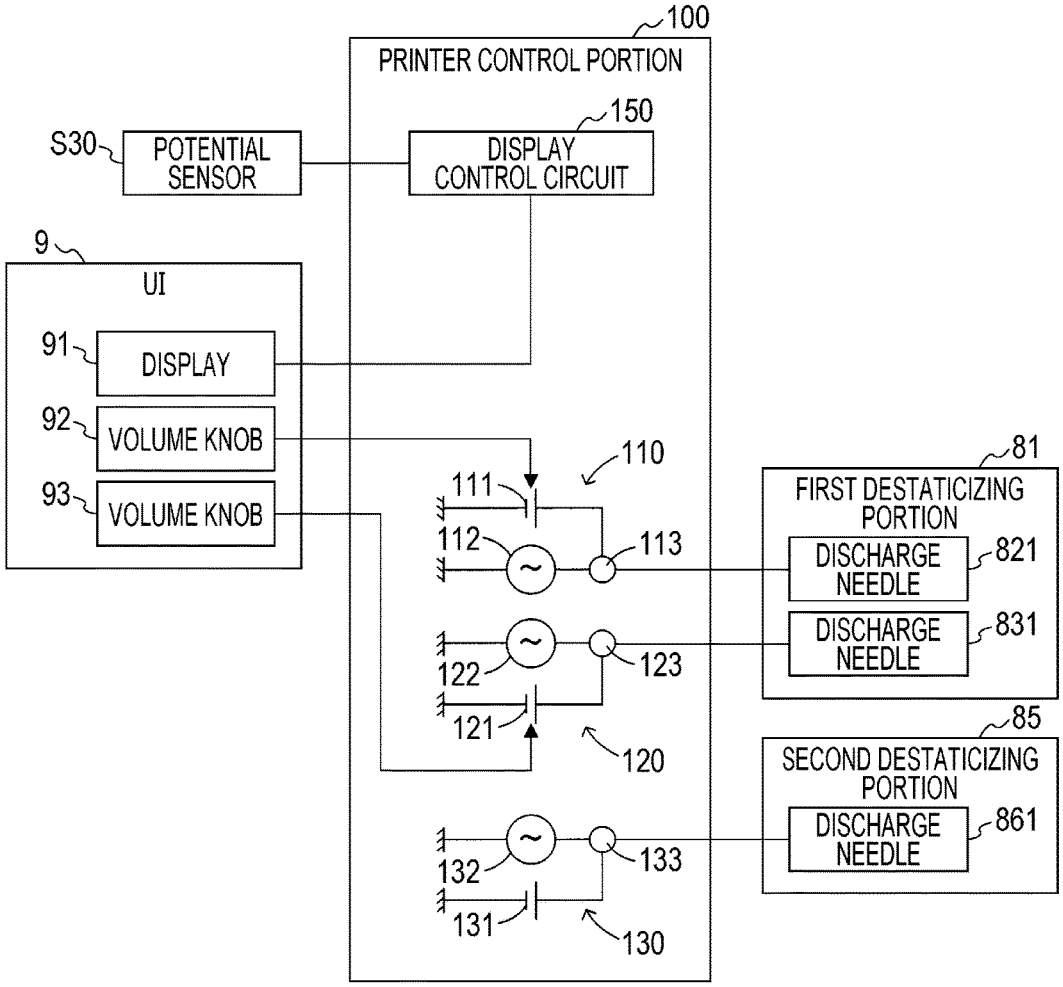
FIG. 7 is a view illustrating a configuration in which a second control example of the destaticizing processing of the sheet is performed.

In addition, the invention is not limited to the above-described embodiment, and it is possible to add various changes to the above-described embodiments as long as the changes do not depart from the idea. Therefore, a configuration illustrated in FIG. 7 is also possible. Here, FIG. 7 is a block diagram illustrating a configuration in which a second control example of the destaticizing processing of the sheet is performed. Here, a difference from the configuration illustrated in FIG. 5 is mainly described, and common configuration elements are given the same reference numerals and the description thereof will be omitted. However, it is needless to say that similar effects are achieved by providing the configuration common to those described above.

In the second control example illustrated in FIG. 7, the printer control portion 100 includes a display control circuit 150, and the display control circuit 150 displays the potential detected by the potential sensor S30 on a display 91 of the UI 9. Therefore, the user can confirm the potential of the sheet S on the rotation drum 30 by the display 91. In addition, in the UI 9, a volume knob 92 which adjusts an output potential of the DC power source 111, and a volume knob 93 which adjusts an output potential of the DC power source 121, are provided. Therefore, it is possible to adjust the bias voltage supplied to the discharge needles 821 and 831 by operating the volume knobs 92 and 93 while confirming the potential of the sheet S on the rotation drum 30 by the display 91.

In this manner, the display 91 (display portion) which displays the detection result of the potential sensor S30, and the volume knobs 92 and 93 (balance control portion) which adjust the ion balance of the first destaticizing portion 81 to the DC power sources 111 and 121 in accordance with the input operation, are provided. According to this, the user can optimize the ion balance by performing the input operation to the volume knobs 92 and 93 while confirming the detection result of the potential sensor S30 displayed on the display 91.

In addition, a specific configuration of the first destaticizing portion 81 may be appropriately changed. For example, the first destaticizing portion 81 may be placed on a conductive (metal) flat plate grounded to one of the front surface ionizer 82 or the rear surface ionizer 83, or may be removed. In addition, the first destaticizing portion 81 can also be configured of one ionizer by omitting one of the front surface ionizer 82 or the rear surface ionizer 83. It is also possible to appropriately change the pitches P82 and P83 of the discharge needles 821 and 831 or the intervals d82 and d83 between the discharge needles 821 and 831 and the sheet S. Furthermore, the disposition of the first destaticizing portion 81 may be changed, and for example, the first destaticizing portion 81 may be disposed between the supporting roller 71 and the driven roller 21, or further on the downstream side in the transport direction Ds than the infeed roller 31.

In addition, a specific configuration of the second destaticizing portion 85 may be appropriately changed. Therefore, it is also possible to appropriately change the pitch P86 of the discharge needle 861 of the front surface ionizer 86 or the interval d86 between the discharge needle 861 and the sheet S. In addition, the disposition of the second destaticizing portion 85 may be changed, or the second destaticizing portion 85 may be omitted.

In addition, in the example of FIG. 5, the feedback control is integrally performed with respect to the DC power sources 111 and 121. However, the feedback control may be performed separately with respect to the DC power sources 111 and 121. In addition, in the example of FIG. 7, a configuration of adjusting the output potential of the DC power sources 111 and 121 separately is illustrated. However, the output potential of the DC power sources 111 and 121 may be configured to be integrally adjusted. Furthermore, a configuration in which the potential sensor S30 is provided, or a configuration in which the output potential of the DC power sources 111 and 121 is variable, is also not necessary.

In addition, in the above-described embodiment, the sheet S is supported by the cylindrical rotation drum 30. However, the shape of the member which supports the sheet S is not limited thereto, and for example, the sheet S may be supported on the front surface of a flat plate.

This application claims priority under 35 U.S.C. § 119 to Japanese Patent Application No. 2016-087210, filed Apr. 25, 2016. The entire disclosure of Japanese Patent Application No. 2016-087210 is hereby incorporated herein by reference.

What is claimed is:

1. A printing apparatus comprising:

a driving roller which drives a recording medium in a predetermined direction by rotation thereof;

a supporting member which supports the recording medium further on the downstream side in the predetermined direction than the driving roller;

a discharge head which is provided to oppose the supporting member and discharges liquid to the recording medium supported by the supporting member;

a tension control portion which adjusts tension of the recording medium supported by the supporting member by controlling tension of the recording medium based on a result of detecting tension of the recording medium further on the downstream side in the predetermined direction than the driving roller;

a first destaticizing portion which destaticizes the recording medium further on the upstream side in the predetermined direction than the driving roller; and a discharger which performs surface modification treatment with respect to the recording medium by imparting discharge energy to the recording medium further on the upstream side in the predetermined direction than the first destaticizing portion.

2. A printing apparatus comprising:

a driving roller which drives a recording medium in a predetermined direction by rotation thereof;

a supporting member which supports the recording medium further on the downstream side in the predetermined direction than the driving roller;

a discharge head which is provided to oppose the supporting member and discharges liquid to the recording medium supported by the supporting member;

a tension control portion which adjusts tension of the recording medium supported by the supporting member by controlling tension of the recording medium based on a result of detecting tension of the recording medium further on the downstream side in the predetermined direction than the driving roller;

a first destaticizing portion which destaticizes the recording medium further on the upstream side in the predetermined direction than the driving roller; and a second destaticizing portion which destaticizes the recording medium between the driving roller and the discharge head.

3. The printing apparatus according to claim 2, wherein the second destaticizing portion is provided to oppose the supporting member.

4. The printing apparatus according to claim 3, wherein a front surface of the supporting member is covered with an insulating layer.

5. The printing apparatus according to claim 3, wherein the first destaticizing portion and the second destaticizing portion destaticize the recording medium by imparting ions generated by applying an AC voltage to a plurality of arranged electrodes to the recording medium, and wherein an amplitude of an AC voltage generated in the recording medium by the AC voltage applied to the electrode of the second destaticizing portion is smaller than an amplitude of an AC voltage generated in the recording medium by the AC voltage applied to the electrode of the first destaticizing portion.

6. The printing apparatus according to claim 5, wherein the first destaticizing portion has a plurality of electrodes provided on one surface side of the recording medium and a plurality of electrodes provided on the other surface side of the recording medium, and wherein a phase of the AC voltage applied to the plurality of electrodes on the one surface side and a phase of the AC voltage applied to the plurality of electrodes on the other surface side are different from each other by 180 degrees.

7. The printing apparatus according to claim 5, wherein an interval between the electrode of the first destaticizing portion and the recording medium is narrower than an interval between the electrode of the second destaticizing portion and the recording medium.

8. The printing apparatus according to claim 5, wherein a pitch at which the plurality of electrodes are arranged in the first destaticizing portion is different from a pitch at which the plurality of electrodes are arranged in the second destaticizing portion.

9. A printing apparatus comprising:

a driving roller which drives a recording medium in a predetermined direction by rotation thereof;

a supporting member which supports the recording medium further on the downstream side in the predetermined direction than the driving roller;

a discharge head which is provided to oppose the supporting member and discharges liquid to the recording medium supported by the supporting member;

a tension control portion which adjusts tension of the recording medium supported by the supporting member by controlling tension of the recording medium based on a result of detecting tension of the recording medium further on the downstream side in the predetermined direction than the driving roller;

a first destaticizing portion which destaticizes the recording medium further on the upstream side in the predetermined direction than the driving roller;

an adjustment portion which adjusts an ion balance of the first destaticizing portion; and a potential detector which detects a potential of the recording medium supported by the supporting member.

10. The printing apparatus according to claim 9, further comprising:

a balance control portion which controls an ion balance of the first destaticizing portion by adjusting the ion balance of the first destaticizing portion to the adjustment portion based on the detection result of the potential detector.

11. The printing apparatus according to claim 9, further comprising:

a display portion which displays the detection result of the potential detector; and a balance control portion which adjusts an ion balance of the first destaticizing portion to the adjustment portion in accordance with an input operation.

* * * * *